US011358178B2

(12) United States Patent
Paul et al.

(10) Patent No.: US 11,358,178 B2
(45) Date of Patent: Jun. 14, 2022

(54) INSPECTION APPARATUS AND METHOD FOR VISUAL INSPECTING ELASTIC PARTICLES

(71) Applicant: ARLANXEO DEUTSCHLAND GMBH, Dormagen (DE)

(72) Inventors: Hanns-Ingolf Paul, Leverkusen (DE); Axel Boensch, Cologne (DE); Guy Vercammen, Niel (BE); Jan Van Loock, Lier (BE)

(73) Assignee: ARLANXEO DEUTSCHLAND GMBH, Dormagen (DE)

( * ) Notice: Subject to any disclaimer, the term of this patent is extended or adjusted under 35 U.S.C. 154(b) by 38 days.

(21) Appl. No.: 16/629,476

(22) PCT Filed: Jul. 6, 2018

(86) PCT No.: PCT/EP2018/068382
§ 371 (c)(1),
(2) Date: Jan. 8, 2020

(87) PCT Pub. No.: WO2019/011809
PCT Pub. Date: Jan. 17, 2019

(65) Prior Publication Data

US 2020/0139410 A1 May 7, 2020

(30) Foreign Application Priority Data

Jul. 10, 2017 (EP) ..... 17180514

(51) Int. Cl.
*B07C 5/34* (2006.01)
*B07C 5/342* (2006.01)
*B07C 5/02* (2006.01)

(52) U.S. Cl.
CPC ..... *B07C 5/3425* (2013.01); *B07C 5/02* (2013.01); *B07C 2501/0018* (2013.01)

(58) Field of Classification Search
CPC ..... B07C 5/02; B07C 5/3425; B07C 5/363; B07C 5/366; B07C 2501/0018
See application file for complete search history.

(56) References Cited

U.S. PATENT DOCUMENTS 3,802,558 A * 4/1974 Rhys ..... B07C 5/02 209/557
4,630,736 A * 12/1986 Maughan ..... B07C 5/366 209/581

(Continued)

FOREIGN PATENT DOCUMENTS

EP 2468426 A1 6/2012
EP 2671651 A1 12/2013

OTHER PUBLICATIONS

International Search Report and Written Opinion, PCT Application No. PCT/EP2018/068382 dated Sep. 21, 2018.

(Continued)

*Primary Examiner* — Joseph C Rodriguez
(74) *Attorney, Agent, or Firm* — The Dobrusin Law Firm, P.C.; Terry M. Finerman

(57) ABSTRACT

The teachings herein relate to an inspection apparatus for visual inspection of elastic particles and to methods of inspecting elastic particles. The inspection apparatus employs at least one flap for stopping or reducing a horizontal portion of the movement of particles leaving a conveyer belt. Preferably the flap dissipates a part of the kinetic energy of the elastic particles and/or reducing a horizontal rebound of the elastic particles. The teachings herein may be employed in a method with improved accuracy of sorting elastic particles.

19 Claims, 1 Drawing Sheet

(56) References Cited

U.S. PATENT DOCUMENTS

| | | | | | |
|---|---|---|---|---|---|
| 4,703,858 | A * | 11/1987 | Ueberreiter | B07C 5/344 | 209/573 |
| 4,715,487 | A * | 12/1987 | Saika | B07C 5/02 | 193/2 R |
| 5,236,092 | A * | 8/1993 | Krotkov | B07C 5/02 | 198/609 |
| 6,305,551 | B1 * | 10/2001 | Ruymen | B07C 5/02 | 193/7 |
| 6,646,218 | B1 * | 11/2003 | Campbell | A24B 1/04 | 209/577 |
| 7,851,722 | B2 * | 12/2010 | Ito | B07C 5/366 | 209/588 |
| 8,247,724 | B2 * | 8/2012 | Mills | B65G 11/083 | 209/576 |
| 8,640,879 | B2 * | 2/2014 | Riise | B29B 17/02 | 209/638 |
| 9,492,849 | B2 * | 11/2016 | Adams | B07C 5/363 | |
| RE47,155 | E * | 12/2018 | Troyer | B07C 5/3425 | |
| 2007/0039856 | A1 | 2/2007 | Adams et al. | | |

OTHER PUBLICATIONS

International Preliminary Report on Patentability, PCT Application No. PCT/EP2018/068382 dated Jan. 14, 2020.

* cited by examiner

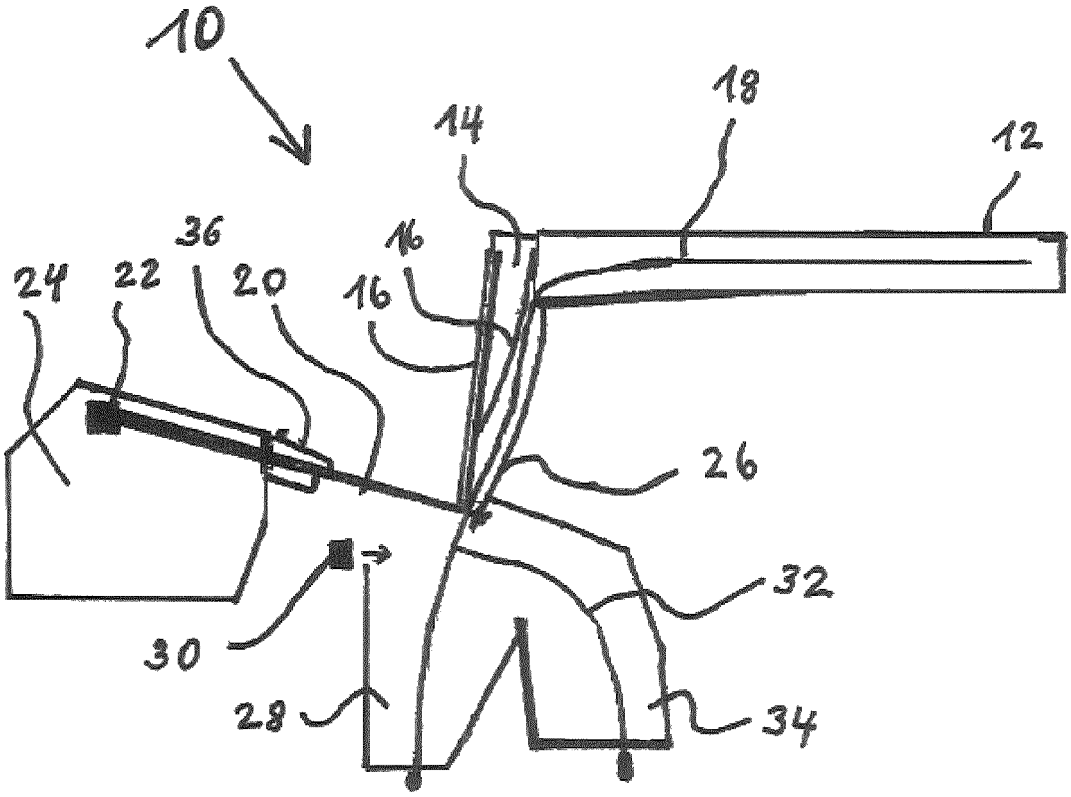
10
14
18
12
36
16
24
22
20
16
26
32
30
28
34

INSPECTION APPARATUS AND METHOD FOR VISUAL INSPECTING ELASTIC PARTICLES

The present invention is directed to an inspection apparatus and a method, by means of which elastic particles can be visually inspected, particularly in order to safeguard a specific form and/or color of the particles. The particles may be inspected for surface contamination.

EP 2 671 651 A1 and EP 2 468 426 A1 disclose an inspection apparatus, where food products like green beans or nuts can be visually inspected for removing unwanted products. The inspection apparatus comprises a conveyor belt by which the food product are move into a fall channel where the food products are scanned from two opposing sides for detecting the form and the color of the food products. Unwanted products are removed by means of a reject system.

When butyl rubber is produced the butyl rubber is present after a polymerization process in form of crumbs of different size. Since these butyl rubber particles are sticky it is possible that several particles agglomerate to a very large particle which may lead to problems in a subsequent processing step. Further it is possible that some particles are not correctly polymerized which may also lead to problems in a subsequent processing step. The not correctly polymerized particles comprises a different color compared to the correctly polymerized particles. Hence, there is a permanent need of sorting unwanted butyl rubber particles out of a plurality of butyl rubber particles.

However, the butyl rubber particles are very elastic so that the butyl rubber particles have a tendency of bouncing away in unpredictable directions when a force is applied to the butyl rubber particles. For that reason the inspection apparatus as disclosed in EP 2 671 651 A1 and EP 2 468 426 A1 proofed as being not suitable for sorting out unwanted elastic butyl rubber particles, since the elastic butyl rubber particles bounced away from the scanning trajectory during the scanning step unpredictably so that the reject system is not able to remove a certain particle with the required accurate recovery.

It is the objective of the invention providing measures enabling a sorting out of unwanted particles out of a plurality of elastic particles during a visual inspection with a good accuracy.

The solution of this objective is provided according to the invention by an inspection apparatus for visual inspecting elastic particles comprising a conveyor belt for feeding a plurality of particles, particularly in mainly a horizontal direction, a fall channel for letting the particles fall downwards due to gravity, wherein the fall channel is arranged downstream the conveyor belt, and at least one flap for stopping or reducing a horizontal portion of the movement of the particles leaving the conveyor belt, wherein the at least one flap is arranged downstream the conveyor belt, wherein the flap is resilient in a horizontal direction for dissipating at least a part, particularly a majority, of a kinetic energy of the particle aligned in the horizontal direction. The solution of this objective is also provided according to the invention by a method for inspecting elastic particles wherein an inspection apparatus according to claim 1, is fed with elastic particles, the form and/or the color of the elastic particles are inspected inside the fall channel and particles whose form and/or color are inside or outside a set of given parameters are sorted out by deflecting these particles out of the falling path of the particles. Preferred embodiments of the invention are given by the dependent claims and the following description, which can constitute each solely or in combination an aspect of the invention.

According to the invention an inspection apparatus for visual inspecting elastic particles is provided comprising a conveyor belt for feeding a plurality of particles, particularly in mainly horizontal direction, a fall channel for letting the particles fall downwards due to gravity, wherein the fall channel is arranged downstream the conveyor belt, and at least one flap for stopping a horizontal portion of the movement of the particles leaving the conveyor belt, wherein the at least one flap is arranged downstream the conveyor belt, wherein the flap is resilient in horizontal direction for dissipating at least a part, particularly a majority, of the kinetic energy of the particle aligned in horizontal direction.

The particles are moved by means of the conveyor belt. Due to the momentum of the particles when the particles reach the end of the conveyor belt the particles leave the conveyor belt and hit the flap. Particularly the at least one flap is arranged upstream the fall channel, particularly at least upstream the majority of the fall channel or preferably upstream an outlet of the fall channel. Due to its resilient behavior of the flap that flap may be elastically deformed by the kinetic energy of the particle so that at least a part of the kinetic energy of the particle may be dissipated by the deforming flap. The elastic flap may damp the movement of the particle and/or reduces the momentum of the particle energized by the movement of the conveyor belt. The respective particle may drip down the flap in mainly vertical direction without a significant rebounding in horizontal direction. Preferably a plurality of flaps are provided so that the respective particle may rebound in a zig-zag-course between two flaps and/or a wall of the fall channel and the same or at least one further flap. Every time when the particle meets a flap at least a part of the kinetic energy of the particle directed in horizontal direction can be dissipated so that the particle may fall downwards mainly vertically when leaving the at least on flap or a chicane of a plurality of flaps. Particularly at least one wall, preferably all walls, of the fall channel is resilient in horizontal direction and/or comprises elastic material for dissipating at least a part, particularly a majority, of the kinetic energy of the particle aligned in horizontal direction, so that the fall channel itself may also damp a rebounding of the particle in horizontal direction. By means of the flap the elastic particles, particularly butyl rubber particles, are able to perform a curve from a mainly horizontal movement to a mainly vertical movement without an unpredictable bouncing so that the particles do not bounce away from a scanning trajectory of a detection system. In turn, a deflection means which may comprise a reject system, may remove a certain particle identified by the detection system with a higher accuracy. The risk that the deflection means, particularly an air gun, may miss the identified particle or even hit the wrong particle is reduced. The inspection apparatus may be further designed as described in EP 2 671 651 A1 and EP 2 468 426 A1 whose content is herewith incorporated as part of the invention. Due the to the resilient elastic flaps it is possible using an inspection apparatus suitable only for rigid non-sticky inelastic particles for very elastic and/or sticky particles. Due to the resilient flaps a horizontal rebounding of the elastic particles is reduced, so that a sorting out of unwanted particles out of a plurality of elastic particles during a visual inspection with a good accuracy is enabled.

Particularly the amount of an inelastic collision of the particle to the flap is greater than the amount of the elastic collision of the particle to the flap. The collision of the elastic particle with the flap may be a mixture of an elastic collision and an inelastic collision. Due to the greater amount of the inelastic collision a majority of the kinetic energy of the particle can be absorbed by the flap. For instance, a significant amount of the kinetic energy of the particle may be transformed into strain energy of the flap and/or friction.

Preferably the flap is made from an elastic material comprising a higher elasticity than steel, wherein the flap particularly comprises a tensed up sheet material, particularly comprising a rubber material and/or a plastic material provided on a textile. The flap may be sufficiently soft for dissipating a significant amount of the kinetic energy of the particle. The flap may be tensed up at two ends facing away from each other, wherein a particular resilient behavior and/or damping behavior may be adjusted by the applied tension.

Particularly preferred the flap and/or an inner surface of the fall channel is coated with a coating comprising an anti-stick material and/or an elastic material, particularly a silicon varnish. Due to this coating even sticky particles may be processed by the inspection apparatus. Particularly an agglomeration of sticky particles at the flap and/or at the wall of the fall channel may be prevented, so that a fouling of the apparatus is prevented. Particularly preferred the coating comprises a chrome layer coated with a silicon layer. This coating shows better test results compared with a Teflon coating, when butyl rubber particles are fed to the inspection apparatus. The anti-stick material may comprise a Ni—Cr alloy applied onto the designated substrate, like a wall of the fall channel, for example by means of plasma thermal spraying. A ceramic primer may be provided onto the alloy and/or the material of the flap, wherein a release agent, particularly thermal cross-linked silicones, is provided onto the ceramic primer for providing a multilayer anti-stick material. The ceramic primer may provide an adhesion between the Ni—Cr alloy and the release agent or between the material of the flap and the release agent. The coating thickness of the Ni—Cr alloy, the ceramic primer and/or the release agent may be ca. 100 μm 175 μm.

Particularly a detection system for detecting the color and/or the size of the particles in the fall channel is provided, wherein the detection system is adapted to inspect the particles from one side only. The detection system may comprise a laser or other light generator for scanning the particles and a light detector for detecting the light reflected by the particle. The signals of the light detector may be analyzed in an image evaluation system, by which the size and/or the color of the particle may be determined. If the analyzed data indicates parameters which are out of a set predefined range the respective particle may be qualified as being unwanted which have to be sorted out from the remaining particles. In this case it is possible that a deflection means, particularly an air gun, may apply a horizontal force to the unwanted particle so that the unwanted particle may be collected at a different place than the remaining particles. Since the flaps prevents an unpredictable bouncing of the elastic particles the further trajectory of the elastic particles may be easily calculated by the detection system so that the deflection means may find the correct particle with a higher accuracy. The calculation effort of the detection system for determining the further trajectory of the elastic particles may be reduced so that a shorter reply time is possible. This enables a shorter height of fall for the elastic particles until an unwanted particle may be sorted out. Surprisingly, the inspection of the falling elastic particles from one side only is sufficient so that a second system for inspecting the particle from the opposite side can be omitted. If a butyl rubber particle is not correctly polymerized the color of this particle is mainly uniform, so that the detection of the color at one side is sufficient. The case of two differently colored sides of one particle does not take place usually. Further the butyl rubber particles are not plate-like formed but based on a more spherical form. Hence, it is not necessary to determine the whole three-dimensional form of one particle. Instead it is sufficient to determine the size of the particle in one scanning plane for estimating the size of the whole particle with a sufficient accuracy. Since a comparison of two or more different images can be omitted the determination of the size and/or the color of the particle is significantly facilitated and accelerated. This enables a shorter height of fall for the elastic particles until an unwanted particle may be sorted out. The reduced required height of fall provides additional building space which can be used for preventing a rebounding of the elastic particle into an unintended area when the elastic particle hits a ground at the end of its movement downwards.

Preferably at least a part of a channel wall of the fall channel is reflective for an inspection light provided from the detection system, wherein the reflective channel wall is provided opposing an entry of the inspection light into the fall channel. Since the particle is inspected from one side only, the opposing side may be designed like a mirror for the light of the detection system. The detection may be able to compare the light reflected by the particle with the light reflected from the channel wall for determining the size and/or the color of the particle. The light reflected from the channel wall may be used as a reference light so that the detection system may be well operable even in different and/or changing lighting conditions. The risk of an error performed by the detection system may be reduced.

Particularly preferred the inspection light provided from the detection system leaves a light generator via an emission opening, wherein a light path of the inspection light between the emission opening and an entry into the fall channel is at least partially covered by a dust shield for preventing an intrusion of particles into the emission opening. For example due to abrasion of the particles very fine dust particles may occur onto the flap. The dust particles may comprise a such low weight that the dust particle may transported against gravity by means of a thermal up wind generated by the heat of the inspection light emitted by the detection system. The dust shield prevents an intrusion of the dust particles into an optic system of the detection system via the emission opening. Further a shadowing effects of the dust particles crossing the light path of the inspection light are prevented, so that the accuracy of the detection system is not decreased by occurring dust particles. If so, an outer surface of the dust shield may be fouled by an agglomeration of sticky dust particles but the emission opening and/or the entry of the inspection light into the fall channel do not narrow significantly by agglomerating sticky dust particles. The period of time between two maintenances for cleaning the inspection apparatus may be extended which in turn increases the working period of the inspection apparatus.

Particularly a protective deflection means, particularly an air gun, for deflecting particles is provided between the emission opening and the dust shield. The protective deflection means may keep dust particles away from the emission opening and/or from the entry of the inspection light into the fall channel. The protective deflection means is adapted providing a force for deflecting the dust particles away without optically hampering the lighting conditions for the inspection light.

Preferably at least one collection container is provided downstream the fall channel, wherein a distance between the maximum filling level of the collection container and an upper rim of the collection container is greater than a maximum height of a particle rebounded from a particle arrange at the maximum filling level after falling a distance of the full height of the fall channel until the maximum filling level. It is used the insight that due to the high elasticity of the elastic particles the elastic particles may bounce back when the elastic particles hit the ground. Due to the significant oversizing of the collection container compared to the maximum filling level an elastic particle falling into the collection container may not escape the collection container again or rebound over the upper rim of the collection container. Usually a collection container for collecting the wanted particles and a collection container for collecting the unwanted particles are arranged side by side, particularly via a dividing wall. Due to the height of at least one of the collection containers it is prevented that a particle for the one collection container may bounce into the other collection container. An impairment of the accuracy for sorting out unwanted particles at a position downstream the detection system and the deflection means is prevented. The collection container may comprise an opening at its bottom, particularly for feeding a conveyor where the particles are transported to a further processing step.

Particularly preferred at least a part of the collection container between the maximum filling level and the upper rim is inclined with respect to the vertical direction. The collection container may comprise a curved course so that a rebounding elastic particle may hit an upper wall of the collection container. The elastic particle may bounce such that the elastic particle provides a zig-zag-course between an upper wall and a lower wall of the inclined part of the collection container, so that the elastic particle does not bounce out of the collection container even when the elastic particle hits a wall of the collection container before passing the maximum filling level.

Particularly the conveyor belt comprises a shaking unit for shaking the particles onto the conveyor belt. The shaking of the conveyor belt may prevent an agglomeration of sticky elastic particles located onto the conveyor belt. An agglomerated particle may by broken into smaller particle which may comprise the intended size. If an agglomerated particle cannot be broken into smaller ones this agglomerated particle may be sorted out. But when the shaking unit prevents an agglomeration or brake an agglomerated particle the amount of unwanted particles and the amount of rejected waste may be reduced.

Preferably a sorting grit for separating too large particles out is provided, wherein particularly the sorting grit is arranged upstream the conveyor belt. The sorting grit may break larger agglomerated particles of sticking elastic particles into smaller ones which may pass the sorting grit. If a large particle cannot be broken into smaller ones this particle can be removed by means of the sorting grit without the need of removing this particle by means of the detection system. The risk that the deflection system may have not sufficient power for sorting out a very large and heavy particle is prevented. The risk that a very large particle is plugging and/or blocking the mainly vertical fall channel is prevented, thus increasing the continuous operation time of the detection device between maintenance intervals.

The invention is further directed to a use of an inspection apparatus, which may be designed as previously described, for sorting out unwanted particles out of a plurality of elastic particles during a visual inspection. Due to the resilient flaps a horizontal rebounding of the elastic particles is reduced, so that a sorting out of unwanted particles out of a plurality of elastic particles during a visual inspection with a good accuracy is enabled.

The invention is further directed to a method for inspecting elastic particles wherein an inspection apparatus, which may be designed as previously described, is fed with elastic particles, the form and/or the color of the elastic particles are inspected inside the fall channel and particles whose form and/or color are inside or outside a set of given parameters are sorted out by deflecting these particles out of the falling path of the particles. Due to the resilient flaps a horizontal rebounding of the elastic particles is reduced, so that a sorting out of unwanted particles out of a plurality of elastic particles during a visual inspection with a good accuracy is enabled.

Particularly the particles are made from butyl rubber (IIR), particularly halogenated butyl rubber. In the alternate the particles may be made from BR, SSBR, NdBR, LiBR, EPDM or similar elastic and/or sticky and/or hygroscopic material. Due to the specific design of the flaps particularly in combination with the specific anti-stick coating even such elastic and/or sticky particles can be fed to the inspection apparatus without the risk of fouling within a short period of time.

Preferably the particles comprises a hardness h in Shore A of $40 \leq h \leq 85$ at 23° C. according to DIN ISO 7619-1. Due to the specific design of the flaps a bouncing of such elastic particles inside the fall channel may be significantly reduced so that it may be prevented that particles bounce out of a scanning trajectory of the inspection apparatus.

These and other aspects of the invention will be apparent from and elucidated with reference to the embodiments described hereinafter, wherein the described features can constitute each solely or in combination an independent aspect of the invention. In the drawings:

FIG. 1: is a schematic perspective view of an inspection apparatus.

The inspection apparatus 10 as illustrated in FIG. 1 comprises a conveyor belt 12 feeding elastic particles into a fall channel 14. The fall channel 14 comprises a plurality of elastic flaps 16 which are resilient in horizontal direction for stopping the elastic particles in a way that the elastic particle do not bounce away horizontally but drop downwards at least after meeting some of the flaps 16. A trajectory 18 of the elastic particles can be bended from a horizontal direction on the conveyor belt 12 into a mostly vertical direction inside the fall channel 14 by means of the resilient flaps 16. The inspection apparatus may include a shaking unit 42 and/or a sorting grit 40, such as illustrated in FIG. 1.

The elastic particles are scanned by a laser inspection light 20 from one side only inside the fall channel 14 or after leaving the fall channel 14. The inspection light 20 is produced in a light generator 22 of a detection system 24. The inspection light 20 is reflected by the elastic particle and/or a reflective channel wall 26 of the fall channel 14. The reflected light can be detected by the detection system 24 for instance by means of photoelectric cells and/or a camera so that the color and/or the form of the elastic particle can be determined. When the inspected elastic particle is acceptable the elastic particle falls further into a collection container 28 for collecting accepted elastic particles. When the inspected elastic particle is not acceptable a deflection means 30 in the form of an air gun provides a force in horizontal direction and changes the trajectory 18 of the elastic particle into a deflected trajectory 32 so that the rejected elastic particle falls into a further collection container 34 for collecting rejected elastic particles which should be removed from the accepted elastic particles. The collection container 28, 34 are open at its bottom so that the collected particles may fall onto a further conveyor for transporting the particles to a further processing step.

For example due to abrasion of the elastic particles very fine dust particles may occur onto the flap 16. The light generator 22 as well as detection means of the detection system 24 are protected by the intrusion of these dust particles by means of a dust shield 36 arranged above the inspection light 20. Particularly the dust shield 36 may protrude along the light path of the inspection light 20.

What is claimed is:

1. An inspection apparatus for visual inspection elastic particles comprising:

a conveyor belt for feeding a plurality of particles, a fall channel for letting the particles fall downwards due to gravity, wherein the fall channel is arranged downstream the conveyor belt, and at least one flap for stopping or reducing a horizontal portion of the movement of the particles leaving the conveyor belt, wherein the at least one flap is arranged downstream the conveyor belt, wherein the flap is resilient in a horizontal direction for dissipating at least a part of a kinetic energy of the particle aligned in the horizontal direction;

wherein a detection system for detecting the color and/or the size of the particles in the fall channel is provided, wherein at least a part of a channel wall of the fall channel is reflective for an inspection light provided from the detection system, wherein the reflective channel wall is provided opposing an entry of the inspection light into the fall channel.

2. The inspection apparatus according to claim 1, wherein an amount of an inelastic collision of the particle to the flaps is greater than an amount of the elastic collision of the particle to the at least one flap.

3. The inspection apparatus according to claim 1, wherein the at least one flap is made from an elastic material comprising a higher elasticity than steel.

4. The inspection apparatus of claim 3, wherein the at least one flap comprises a tensed up sheet material, comprising a rubber material and/or a plastic material provided on a textile.

5. The inspection apparatus according to claim 1, wherein the at least one flap and/or an inner surface of the fall channel is coated with a coating comprising an anti-stick material and/or an elastic material.

6. The inspection apparatus according to claim 1, wherein the inspection apparatus comprises a shaking unit for shaking the particles onto the conveyor belt.

7. The inspection apparatus according to claim 6, wherein a sorting grit for separating too large particles out is provided.

8. The inspection apparatus of claim 7, wherein the sorting grit is arranged upstream the conveyor belt.

9. The inspection apparatus of claim 1, wherein the at least one flap is resilient in a horizontal direction for dissipating a majority of the kinetic energy of the particle aligned in the horizontal direction.

10. An inspection apparatus for visual inspection elastic particles comprising:

a conveyor belt for feeding a plurality of particles, a fall channel for letting the particles fall downwards due to gravity, wherein the fall channel is arranged downstream the conveyor belt, and at least one flap for stopping or reducing a horizontal portion of the movement of the particles leaving the conveyor belt, wherein the at least one flap is arranged downstream the conveyor belt, wherein the flap is resilient in a horizontal direction for dissipating at least a part majority, of a kinetic energy of the particle aligned in the horizontal direction;

wherein a detection system for detecting the color and/or the size of the particles in the fall channel is provided, wherein an inspection light provided from the detection system leaves a light generator via an emission opening, wherein a light path of the inspection light between the emission opening and an entry into the fall channel is at least partially covered by a dust shield for preventing an intrusion of particles into the emission opening.

11. The inspection apparatus according to claim 1, wherein a detection system for detecting the color and/or the size of the particles in the fall channel is provided, wherein the detection system is adapted to inspect the particles from one side only.

12. The inspection apparatus according to claim 10 wherein a protective deflection means, for deflecting particles is provided between the emission opening and the dust shield.

13. The inspection apparatus of claim 12, wherein the protective deflection means is an air gun.

14. The inspection apparatus according to claim 10, wherein at least one collection container s provided downstream the fall channel, wherein a distance between a maximum filling level of the collection container and an upper rim of the collection container is greater than a maximum height of a particle rebounded from a particle arrange at the maximum filling level after falling a distance of a full height of the fall channel until the maximum filling level.

15. The inspection apparatus according to claim 14 wherein at least a part of the collection container between the maximum filling level and the upper rim is inclined with respect to the vertical direction.

16. A method for inspecting elastic particles with the inspection apparatus according to claim 1, wherein the method comprises steps of:

feeding the inspection apparatus with the elastic particles, inspecting a form and/or a color of the elastic particles inside the fall channel and sorting out particles whose form and/or color are inside or outside a set of given parameters by deflecting these particles out of the falling path of the particles;

wherein the step of inspecting includes reflecting an inspection light off of a reflective channel wall of the fall channel.

17. The method according to claim 16 wherein the particles are made from a butyl rubber or a halogenated butyl rubber.

18. The method according to claim 16 wherein the particles comprises a hardness h in Shore A of $40 \leq h \leq 85$ at 23° C. according to DIN ISO 7619-1.

19. The method according to claim 16 wherein the particles are made from a butyl rubber (IIR), a halogenated butyl rubber, a solution styrene-butadiene rubber (SSBR), a neodymium butadiene rubber (NdBR), a lithium butadiene rubber (LiBR), or an ethylene propylene diene rubber (EPDM).

* * * * *